US005558168A

United States Patent [19]

Rahm

[11] Patent Number: 5,558,168

[45] Date of Patent: Sep. 24, 1996

[54] PHENMATIC POWER NUTRUNNER

[75] Inventor: Erik R. Rahm, Väsby, Sweden

[73] Assignee: Atlas Copco Tools AB, Nacka, Sweden

[21] Appl. No.: 390,652

[22] Filed: Feb. 17, 1995

[51] Int. Cl.[6] ..... B25B 23/145

[52] U.S. Cl. ..... 173/178; 192/150

[58] Field of Search ..... 173/176, 178; 192/150, .034; 81/470

[56] References Cited

U.S. PATENT DOCUMENTS

| | | | |
|---|---|---|---|
| 4,078,618 | 3/1978 | Depagter et al. . | |
| 4,223,745 | 9/1980 | Workman, Jr. . | |
| 4,480,699 | 11/1984 | Elmer . | |
| 4,631,992 | 12/1986 | Eckman . | |
| 4,880,064 | 11/1989 | Willoughby et al. . | |
| 5,060,771 | 10/1991 | Robinson | 173/178 |
| 5,060,772 | 10/1991 | Anders et al. | 173/178 |
| 5,129,465 | 7/1992 | Rahm | 173/178 |
| 5,156,244 | 10/1992 | Pyles et al. | 173/178 |
| 5,310,010 | 5/1994 | Lo | 173/178 |

*Primary Examiner*—Scott A. Smith
*Attorney, Agent, or Firm*—Frishauf, Holtz, Goodman, Langer & Chick

[57] ABSTRACT

A pneumatic power nutrunner comprises a housing (10), a rotation motor (19), an air inlet passage (15), a torque limiting release clutch (20) located between the motor (19) and an output shaft (13), which clutch (20) includes over-riding cam elements (24, 25) spring biassed via a thrust sleeve (26), and a shut-off valve (30) in the air inlet passage (15) axially supported by an activating rod (32, 36) which by its forward end engages a latch (40) radially displaceable into a recess (42) in the thrust sleeve (26) for releasing the activating rod (32, 36) and the shut-off valve (30) for axial displacement at clutch release. The shut-off valve (30) comprises a pneumatic actuator (31, 34) for accomplishing an extension of the axial displacement of the activating rod (32, 36) at part closure of the shut-off valve (30). Cam elements (39, 43) on the activating rod (32, 36) and the thrust sleeve (26) are arranged to cooperate with the latch (40) to accomplish an extension of the thrust sleeve (26) displacement at clutch release and closure of the shut-off valve (30).

8 Claims, 2 Drawing Sheets

PHENMATIC POWER NUTRUNNER

BACKGROUND OF THE INVENTION

This invention relates to a power nutrunner of the type having a rotation motor drivingly coupled to an output shaft via a power transmission which includes a torque limiting release clutch with overriding cam means and a spring biassed thrust sleeve acting on the cam means, and a shut-off valve operated by an axially extending activating rod and a radially displaceable latch means cooperating with a recess in the thrust sleeve. A nutrunner of this type is disclosed in for instance U.S. Pat. No. 3,993,145.

SUMMARY OF THE INVENTION

A general problem concerned with power nutrunners of the above type is to keep down the variations in the desired maximum output torque when tightening screw joints of different torque growth characteristics, i.e. to obtain a low torque mean shift at different screw joints. It is also a problem to find an overall nutrunner design by which the final torque scattering is minimized when tightening screw joints of the same torque growth characteristics.

Principally, the above problems may be solved by a nutrunner which has both a low total moment of inertia of the elements which are inseparable from the screw joint at clutch release, for instance the driven clutch half, and a torque limiting clutch with a fast low inertia action and a completely disengaging release action.

Additional problems are to keep down the overall size and weight of the nutrunner as well as to avoid structural complexity and expensive manufacturing.

One of the above described problems concerns the difficulty to have the release clutch disengage completely at the release torque level to, thereby, ensure that no further torque is transferred to the joint being tightened after the attainment of the desired torque level.

One way of accomplishing a complete disengagement of the torque release clutch of a pneumatic nutrunner is shown in U.S. Pat. No. 3,298,481. In the nutrunner described therein, the shut-off valve comprises a pneumatic actuator means which uses the push rod to apply an axial disengagement force on one of the clutch halves as the desired release torque level is reached.

However, this known device is disadvantageous in that the pneumatic actuating means acts directly against the full load of the clutch biassing spring, which means that the size of the actuating means has to be rather big.

Another way of accomplishing a complete breakage of the torque transmission to the output shaft is to use a secondary clutch which is fully disengaged as the torque responsive release clutch has passed its set maximum torque level. Such a device is shown in U.S. Pat. No. 5,167,309. The drawback of this known power nutrunner is a rather complex and expensive design.

The above discussed problems and disadvantages are overcome by the combination of the characteristic features of the invention as defined in the claims.

A preferred embodiment of the invention is described below in detail with reference to the accompanying drawings.

DESCRIPTION OF THE PREFERRED EMBODIMENT

Figure 1:
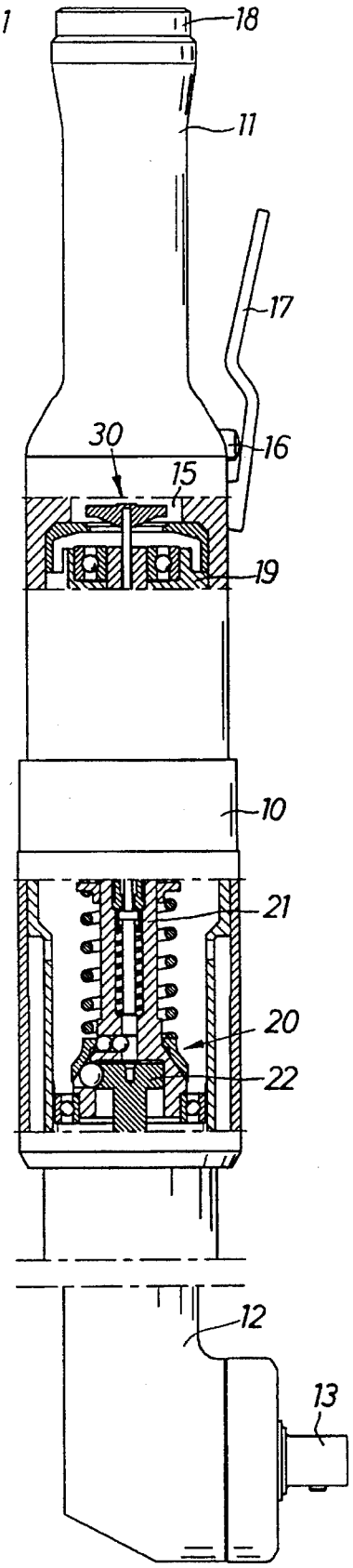
FIG. 1 shows a side view, partly in section, of an angle nutrunner according to the invention.
Figure 5:
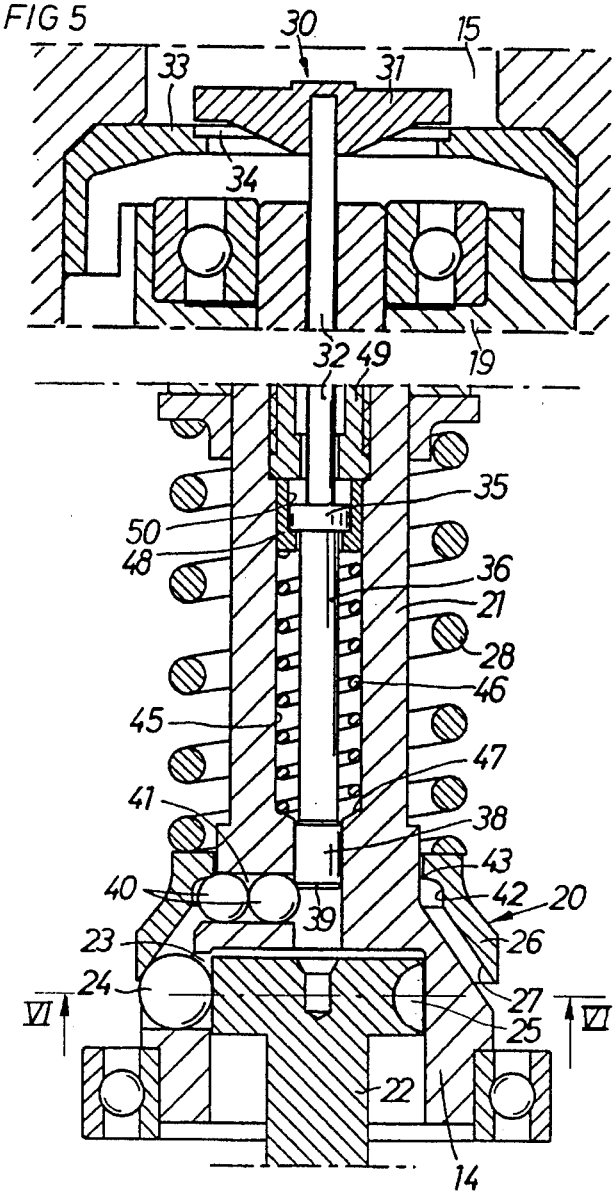
FIG. 5 shows, on a larger scale, a longitudinal fragmentary section through the release clutch mechanism.

The angle nutrunner illustrated in the drawing figures is a pneumatically powered tool comprising a housing 10 formed with a handle 11 at its rear end and an angle head 12 with an output shaft 13 at its forward end.

In the handle 11 there is located a pressure air inlet passage 15 and a throttle valve 16 operable by a lever 17. By a threaded socket 18 at the rear end of the handle 11 the inlet passage 15 is connectable to a pressure air source.

Figure 6:
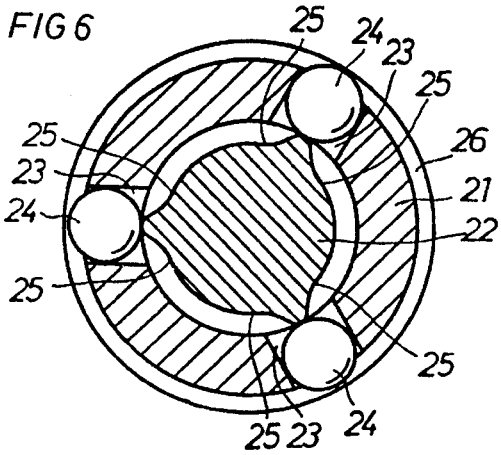
FIG. 6 shows a cross sectional view of the release clutch mechanism.

A pneumatic vane type rotation motor 19 is drivingly connected to the output shaft 13 via a power transmission including a reduction gearing (not shown) and a torque responsive release clutch 20. The latter comprises a driving half 21 spline connected to the rotor of the motor 19, and a driven half 22 coupled to the reduction gearing. The driving clutch half 21 has a tubular portion 14 which receives the rear end of the driven clutch half 22. The driving clutch half 21 is also formed with three radial bores 23 each supporting a ball 24 for cooperation with radially acting cam surfaces 25 on the rear end of the driven clutch half 22. See FIG. 6. The cam surfaces 25 are symmetrically disposed so as to provide for a release function at reverse rotation as well.

A thrust sleeve 26 is formed with an inner conical cam surface 27 for contact with the balls 24 and is axially loaded by a spring 28 to exert a radial bias force on the balls 24 against the cam surfaces 25.

Due to the fact that the driven clutch half 22 is disposed inside the tubular portion 14 of the driving clutch half 21 and is formed with radially acting cam surfaces 25, the outer diameter as well as the moment of inertia of the driven clutch half 22 is very low.

A shut-off valve 30 located in the air inlet passage 15 comprises a valve disc 31 rigidly mounted on a valve rod 32, and a seat 33. The seat 33 comprises a cylindrical socket portion 34 for sealingly receiving the valve disc 31 at closure of the valve. The valve rod 32 extends axially through the motor 18 and rests by its forward end on a rear head 35 of a push rod 36. The latter is movably guided within the driving clutch half 21 for longitudinal displacement between a rear rest position in which it supports the shut-off valve 30 in open position and a forward active position in which the shut-off valve 30 is allowed to occupy its closed position.

Figure 2A:
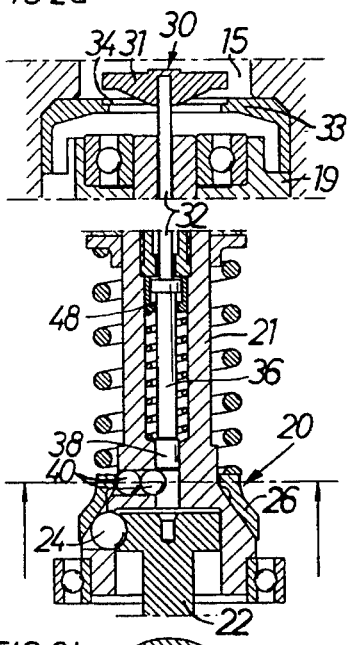
FIGS. 2*a*, 3*a*, and 4*a* show in longitudinal sections different operational positions of the release clutch mechanism.
Figure 3A:
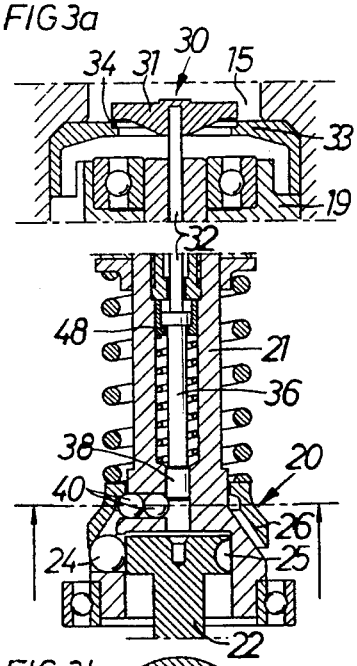
Figure 4A:
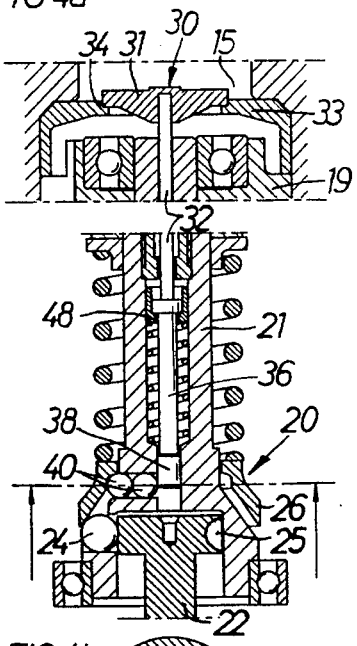
Figure 2B:
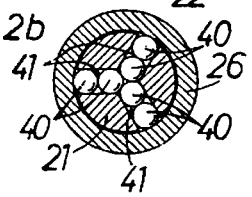
FIGS. 2*b*, 3*b*, and 4*b* show, in cross sectional views, different operational positions of the shut-off initiating mechanism.
Figure 3B:
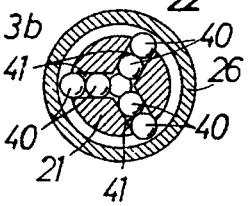
Figure 4B:
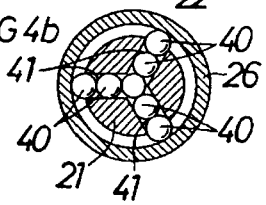

At its forward end the push rod 36 is formed with a cam head 38 which has a conical cam surface 39 for cooperation with latch balls 40 located in pairs in three symmetrially disposed radial bores 41. See FIGS. 2*b*, 3*b*, and 4*b*. The outer balls 40 abut against the thrust sleeve 26 which is formed with an annular recess 42. The upper edge 43 of the recess 42 forms a cam means for camming cooperation with the outer balls 40.

In an axial bore 45 in the driving clutch half 21 there is located a spring 46 which is pretensioned between a shoulder 47 in the bore 45 and a socket sleeve 48. The latter rests against a shoulder formed by a tubular plug 49 inserted in the bore 45 and forms a radial support for the rear head 35 of the push rod 36. The socket portion 50 of the sleeve 48 has a larger axial extent than the head 35 of the push rod 36 which provides for a certain axial movability of the head 35 in relation to the sleeve 48.

In operation of the tool the air inlet passage 15 is connected to a pressure air source via socket 18, and the output shaft 13 is connected to a threaded joint to be tightened by means of a nut socket.

In the start condition of the tool, the balls 24 are in full contact with the cam surfaces 25 of the driven clutch half 22 so as to transfer torque between the clutch halves, the thrust sleeve 26 is in its forwardmost position, and the latch balls 40 occupy their innermost positions so as to form an axial support for the push rod 36 and, thereby, the valve rod 32. Accordingly, the shutoff valve 30 is locked in its raised open position to let through motive air to the motor 19. See FIGS. 2*a*, 2*b*.

The motor 19 is started in that the lever 17 is pressed and the throttle valve 16 is opened. Pressure air also passes the open shut-off valve 30 and starts rotating the motor 19.

During the initial running down phase of the tightening process a very low torque resistance only is experienced from the joint, which means that the torque load on the release clutch 20 is very low. This means in turn that the balls 24 have not started climbing the cam surfaces 25 and the thrust sleeve 26 still occupies its forwardmost position.

As the torque resistance in the joint increases the balls 24 start climbing the cam surfaces 25 and are, thereby urged radially outwardly. Due to the interaction between the conical cam surface 27 of the thrust sleeve 26 and the balls 24, the thrust sleeve 21 is displaced axially backwards against the load of the spring 28.

As the desired maximum torque level, determined by the set preload of the spring 28, is attained the balls 24 have reached the top crests of the cam surfaces 25. See FIGS. 3*a*, 3*b* and 6.

At this point, the thrust sleeve 26 has been pushed back to a position where the outer latch balls 40 start entering the annular recess 42 in the thrust sleeve 26. This means that the inner balls 40 as well are moved outwardly letting the push rod 36 advance forwards under an axial load generated by the pressure drop across the shut-off valve 30. Due to the fact that length of the socket portion 50 of the socket sleeve 48 is larger than the axial extent of the rear head 35, the push rod 36 has been able to move freely without influence of the spring 46 for a certain initial distance.

After this initial movement or part closure of the shut-off valve 30, the cam surface 39 of the push rod head 38 has come into contact with the inner balls 40, whereas the outer balls 40 engage the upper edge 43 of the thrust sleeve recess 42. This forward movement of the push rod 36 and the valve rod 32 has brought the valve disc 31 to the edge of the valve seat socket portion 34, which means that the pressure drop across the valve disc 31 increases rapidly to the level of the full supply pressure of the motive air. See FIG. 3*a*.

Now, the valve disc 31 acts as an actuating piston and shifts rapidly the valve rod 32 and the push rod 36 to their forwardmost positions. As the rear push rod head 35 has reached the bottom of the socket portion 50 of the sleeve 48, the sleeve 48 is now moved forwardly against the load of the spring 46. At the same time, the cam surface 39 of the forward push rod head 38 urges the latch balls 40 outwardly, and due to their engagement with the recess edge 43 on the thrust sleeve 26 the latter is displaced further rearwardly a short distance to fully disengage the thrust sleeve 26 from the balls 24. During this camming action between the push rod head 38 and the inner latch balls 40 and between the outer latch balls 40 and the thrust sleeve recess edge 43 the axial movement of the push rod 36, the valve rod 32 and the valve disc 31 has brought the shut-off valve 30 to closed position. The motor is stopped and the tightening process is completed.

The release clutch and shut-off mechanism is reset automatically by the spring 46 as soon as the throttle valve 16 is closed and the shut-off valve 30 is depressurized. Accordingly, the spring 46 lifts up the push rod 36 to a position where the socket sleeve 48 abuts against the plug 49. In this position the cam surface 39 of the push rod 36 has passed the centre of the inner latch balls 40, and the camming action between the outer latch balls 40 and the edge 43 on the thrust sleeve 26, which urges the latch balls 40 inwardly, results in reversed camming action between the inner latch balls 40 and the push rod head 38 pushing the push rod 36, the valve rod 32 and the valve disc 31 rearwardly. Since the latch balls 40 have now occupied their innermost positions, the push rod 36 is locked against forward movement and the shut-off valve 30 is maintained in its open position. Thereby, another tightening process may be commenced. See FIGS. 2*a* and 2*b*.

By the invention there is obtained a constructively very simple nutrunner design providing a low mean shift and a low scattering of the output torque at tightening of different types of screw joints. This is mainly due to a clutch design which provides a complete disengagement of the clutch halves at the attainment of the desired maximum torque level and to the fact that the driven clutch half has a low moment of inertia.

I claim:

1. A pneumatic power nutrunner, comprising:

a rotation motor (19), a pressure air inlet passage (15), an air shut-off valve (30) in said inlet passage (15), an output shaft (13), a torque limiting release clutch (20) located between said motor (19) and said output shaft (13) and including a driving clutch half (21), torque transferring rolling elements (24), and a driven clutch half (22) formed with cam surfaces (25) engaging said rolling elements (24), a release torque determining thrust sleeve (26) which is spring biassed into engagement with said rolling elements (24) and which is movably guided on said driving clutch half (21) for axial displacement at release of said clutch, said thrust sleeve (26) having an internal recess (42), an activating rod (32, 36) connected to said shut-off valve (30) and extending through an axial bore (45) in said driving clutch half (21), and a latch means (40) radially movable relative to said driving clutch half (21) from an activating rod (32, 36) locking position to an activating rod (32, 36) releasing position at release of said clutch (20), thereby entering partly said recess (42), wherein:

said driving clutch half (21) has a tubular portion (14) with radial apertures (23) in which said rolling elements (24) are movably supported, said driven clutch half (22) is partly received in said tubular portion (14), said cam surfaces (25) on said driven clutch half (21) are radially acting and are located within said tubular portion (14), said shut-off valve (30) comprises an actuating means (31, 34) activated at part closure of said shut-off valve (30) for generating an axial actuating force on said activating rod (32, 36) and, said activating rod (32, 36) and said thrust sleeve (26) are provided with cam means (39, 43) for interacting with said latch means (40) to transmit the actuating force of said actuating means (31, 34) to said thrust sleeve (26), thereby extending said thrust sleeve displacement to a complete disengagement with said rolling elements (24) at release of said clutch (20) and closure of said shut-off valve (30).

2. Nutrunner according to claim 1, wherein said recess (42) comprises an annular groove having one circumferential edge (43) which forms one part of said cam means (39, 43).

3. Nutrunner according to claim 2, wherein said axial bore (45) comprises two opposed shoulders (47, 49), a spring (46) is pretensioned between said shoulders (47, 49), and said push rod (36) is provided with a shoulder (35) which is arranged to engage and lift said spring (46) off one of said opposed shoulders (49) at said extended push rod displacement only.

4. Nutrunner according to claim 3, wherein said latch means (40) comprises a number of balls displaceably guided in two or more radial bores (41) in said driving clutch half (21).

5. Nutrunner according to claim 2, wherein said latch means (40) comprises a number of balls displaceably guided in two or more radial bores (41) in said driving clutch half (21).

6. Nutrunner according to claim 1, wherein said axial bore (45) comprises two opposed shoulders (47, 49), a spring (46) is pretensioned between said shoulders (47, 49), and said push rod (36) is provided with a shoulder (35) which is arranged to engage and lift said spring (46) off one of said opposed shoulders (49) at said extended push rod displacement only.

7. Nutrunner according to claim 6, wherein said latch means (40) comprises a number of balls displaceably guided in two or more radial bores (41) in said driving clutch half (21).

8. Nutrunner according to claim 1, wherein said latch means (40) comprises a number of balls displaceably guided in two or more radial bores (41) in said driving clutch half (21).

* * * * *